US006554688B2

(12) United States Patent
Lacy

(10) Patent No.: US 6,554,688 B2
(45) Date of Patent: Apr. 29, 2003

(54) METHOD AND APPARATUS FOR CONDITIONING A POLISHING PAD WITH SONIC ENERGY

(75) Inventor: Michael S. Lacy, Pleasanton, CA (US)

(73) Assignee: Lam Research Corporation, Fremont, CA (US)

( * ) Notice: Subject to any disclaimer, the term of this patent is extended or adjusted under 35 U.S.C. 154(b) by 67 days.

(21) Appl. No.: 09/754,702

(22) Filed: Jan. 4, 2001

(65) Prior Publication Data

US 2002/0086620 A1 Jul. 4, 2002

(51) Int. Cl.[7] ..... B24B 1/00

(52) U.S. Cl. ..... 451/56; 451/72; 451/443; 451/444

(58) Field of Search ..... 451/56, 72, 443, 451/910; 51/121, 122, 230, 317; 438/692, 633, 959

(56) References Cited

U.S. PATENT DOCUMENTS

| | | | | |
|---|---|---|---|---|
| 2,702,692 A | * | 2/1955 | Kessler | 366/113 |
| 3,753,269 A | | 8/1973 | Budman | |
| 4,318,250 A | | 3/1982 | Klievoneit et al. | |
| 4,672,985 A | | 6/1987 | Mohr | |
| 4,720,939 A | | 1/1988 | Simpson et al. | |
| 4,934,102 A | | 6/1990 | Leach et al. | |
| 5,081,051 A | | 1/1992 | Mattingly et al. | |
| 5,245,790 A | | 9/1993 | Jerbic | |
| 5,245,796 A | * | 9/1993 | Miller et al. | 438/692 |

(List continued on next page.)

FOREIGN PATENT DOCUMENTS

| | | |
|---|---|---|
| WO | WO 98/45090 | 10/1998 |
| WO | WO 99/22908 | 5/1999 |

OTHER PUBLICATIONS

S. Inaba, T. Katsuyama, M. Tanaka, "Study of CMP Polishing pad Control Method," 1998 CMP–MIC Conference, Feb. 19–20, 1998, 1998 IMIC—300P/98/0444.

MegaSonics Cleaner Products, http://www.prosysmeg.com/html/body_prod_transducer.html.

ProSys Product Systems Inc., http://ww.prosysmeg.com/body_index.html.

U.S. patent application Ser. No. 09/475,518: "Method and Apparatus for Conditioning a Polishing Pad"; Inventor: Finkelman; Filed: Dec. 30, 1999; Attorney Docket No. 7103–117.

U.S. patent application Ser. No. 09/540,385: "Method and Apparatus for Chemically–Mechanically Polishing Semiconductor Wafers"; Inventors; Travis et al.; Filed Mar. 31, 2000; Attorney Docket No. 7103–123.

U.S. patent application Ser. No. 09/540,602: "Method and Apparatus for Conditioning a Polishing Pad"; Inventor: John M. Boyd; Filed Mar. 31, 2000; Attorney Docket No. 7103–133.

(List continued on next page.)

*Primary Examiner*—Joseph J. Hail, III
*Assistant Examiner*—Anthony Ojini
(74) *Attorney, Agent, or Firm*—Brinks Hofer Gilson & Lione

(57) ABSTRACT

A method and apparatus for conditioning a polishing pad is described, wherein the polishing pad has a polishing surface for polishing the semiconductor wafer, and a back surface opposed to the polishing surface. The method includes positioning a sonic energy generator adjacent to the back surface of the polishing pad, and generating sonic energy through the back surface of the polishing pad. The apparatus includes a sonic energy generator adapted to be positioned adjacent the back surface, the sonic energy generator including a transducer connected to a contact member, wherein the sonic energy generator is adapted to transmit sonic energy in a direction through the back surface and to the polishing surface of the polishing belt.

24 Claims, 3 Drawing Sheets

U.S. PATENT DOCUMENTS

| | | | | | |
|---|---|---|---|---|---|
| 5,335,453 | A | | 8/1994 | Baldy et al. | |
| 5,484,323 | A | | 1/1996 | Smith | |
| 5,522,965 | A | * | 6/1996 | Chisholm et al. | 156/345.12 |
| 5,531,635 | A | | 7/1996 | Mogi et al. | |
| 5,536,202 | A | | 7/1996 | Appel et al. | |
| 5,547,417 | A | | 8/1996 | Breivogel et al. | |
| 5,558,568 | A | | 9/1996 | Talieh et al. | |
| 5,575,707 | A | | 11/1996 | Talieh et al. | |
| 5,593,344 | A | | 1/1997 | Weldon et al. | |
| 5,611,943 | A | | 3/1997 | Cadien et al. | |
| 5,622,526 | A | | 4/1997 | Phillips | |
| 5,643,044 | A | | 7/1997 | Lund | |
| 5,655,951 | A | | 8/1997 | Meikle et al. | |
| 5,692,947 | A | | 12/1997 | Talieh et al. | |
| 5,692,950 | A | | 12/1997 | Rutherford et al. | |
| 5,725,417 | A | | 3/1998 | Robinson | |
| 5,759,918 | A | | 6/1998 | Hoshizaki et al. | |
| 5,762,536 | A | * | 6/1998 | Pant et al. | 451/296 |
| 5,779,526 | A | | 7/1998 | Gill | |
| 5,871,390 | A | | 2/1999 | Pant et al. | |
| 5,897,426 | A | | 4/1999 | Somekh | |
| 5,899,798 | A | | 5/1999 | Trojan et al. | |
| 5,908,530 | A | | 6/1999 | Hoshizaki et al. | |
| 5,958,794 | A | | 9/1999 | Bruxvoort et al. | |
| 5,975,094 | A | | 11/1999 | Shurtliff | |
| 6,024,829 | A | * | 2/2000 | Easter et al. | 156/345.12 |
| 6,083,085 | A | * | 7/2000 | Lankford | 451/56 |
| 6,086,460 | A | | 7/2000 | Labunsky et al. | |
| 6,123,607 | A | | 9/2000 | Ravkin et al. | |
| 6,184,139 | B1 | * | 2/2001 | Adams et al. | 438/691 |

OTHER PUBLICATIONS

U.S. patent application Ser. No. 09/540,810: "Fixed Abrasive Linear Polishing Belt and System"; Inventors: Zhao et al.; Filed Mar. 31, 2000; Attorney Docket No. 7103–135.

U.S. patent application Ser. No. 09/541,144: "Method and Apparatus for Chemical Mechanical Planarization and Polishing of Semiconductor Wafers Using a Continuous Polishing Member Feed"; Inventors: Mooring et al.; Filed Mar. 31, 2000; Attorney Docket No. 7103–165.

U.S. patent application Ser. No. 09/607,743: "A Conditioning Mechanism in a Chemical Mechanical Polishing Apparatus for Semiconductor Wafers"; Inventors: Vogtmann et al.; Filed Jun. 30, 2000; Attorney Docket No. 7103–173.

U.S. patent application Ser. No. 09/607,895: "Apparatus and Method for Conditioning a Fixed Abrasive Polishing Pad in a Chemical Mechanical Planarization Process"; Inventors: Ravkin et al.; Filed Jun. 30, 2000; Attorney Docket No. 7103–180.

U.S. pending patent application Ser. No. 09/796,955, Entitled "Method and Apparatus for Conditioning a Polishing Pad with Sonic Energy," Our Ref. 7103–189.

* cited by examiner

METHOD AND APPARATUS FOR CONDITIONING A POLISHING PAD WITH SONIC ENERGY

FIELD OF THE INVENTION

The present invention relates to a method and apparatus for conditioning a polishing pad. More particularly, the present invention relates to a method and apparatus for conditioning a polishing pad used in the chemical mechanical planarization of semiconductor wafers.

BACKGROUND

Semiconductor wafers are typically fabricated with multiple copies of a desired integrated circuit design that will later be separated and made into individual chips. A common technique for forming the circuitry on a semiconductor is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive toward smaller, more highly integrated circuit designs. Semiconductor wafers are also commonly constructed in layers, where a portion of a circuit is created on a first level and conductive vias are made to connect up to the next level of the circuit. After each layer of the circuit is etched on the wafer, a dielectric layer is put down allowing the vias to pass through but covering the rest of the previous circuit level. Each layer of the circuit can create or add unevenness to the wafer that is preferably smoothed out before generating the next circuit layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. A polishing fluid, such as a chemical polishing agent or slurry containing microabrasives, is applied to the polishing pad to polish the wafer. The wafer holder then presses the wafer against the rotating polishing pad and is rotated to polish and planarize the wafer.

During the polishing process, the properties of the polishing pad can change. Slurry particles and polishing byproducts accumulate on the surface of the pad. Polishing byproducts and morphology changes on the pad surface affect the properties of the polishing pad and cause the polishing pad to suffer from a reduction in both its polishing rate and performance uniformity. To maintain a consistent pad surface, provide microchannels for slurry transport, and remove debris or byproducts generated during the CMP process, polishing pads are typically conditioned. Pad conditioning restores the polishing pad's properties by re-abrading or otherwise restoring the surface of the polishing pad. This conditioning process enables the pad to maintain a stable removal rate while polishing a substrate or planarizing a deposited layer and lessens the impact of pad degradation on the quality of the polished substrate.

Typically, during the conditioning process, a conditioner used to recondition the polishing pad's surface comes into contact with the pad and re-abrades the pad's surface. The type of conditioner used depends on the pad type. For example, hard polishing pads, typically constructed of synthetic polymers such as polyurethane, require the conditioner to be made of a very hard material, such as diamond, serrated steel, or ceramic bits, to condition the pad. Intermediate polishing pads with extended fibers require a softer material, often a brush with stiff bristles, to condition the pad. Meanwhile, soft polishing pads, such as those made of felt, are best conditioned by a soft bristle brush or a pressurized spray.

One method used for conditioning a polishing pad uses a rotary disk embedded with diamond particles to roughen the surface of the polishing pad. Typically, the disk is brought against the polishing pad and rotated about an axis perpendicular to the polishing pad while the polishing pad is rotated. The diamond-coated disks produce predetermined microgrooves on the surface of the polishing pad. Another method used for conditioning a polishing pad uses a rotatable bar on the end of a mechanical arm. The bar may have diamond grit embedded in it or high pressure nozzles disposed along its length. In operation, the mechanical arm swings the bar out over the rotating polishing pad and the bar is rotated about an axis perpendicular to the polishing pad in order to score the polishing pad, or spray pressurized liquid on the polishing pad, in a concentric pattern.

The life of a polishing pad is a key factor in the cost of a CMP process. By applying abrasive materials directly to the surface of the polishing pad, conventional pad conditioners, as described above, erode the surface and reduce the life of the polishing pad. Accordingly, advances in methods and apparatuses for conditioning polishing pads used in the chemical mechanical planarization of semiconductor wafers, are necessary to improve, for example, polishing pad life.

SUMMARY

According to a first aspect of the present invention, a method for conditioning a polishing pad used in chemical mechanical planarization of a semiconductor wafer is provided. The polishing pad has a polishing surface for polishing the semiconductor wafer and a back surface opposed to the polishing surface. The method includes positioning a sonic energy generator adjacent to the back surface of the polishing pad, and generating sonic energy through the back surface of the polishing pad.

According to another aspect of the present invention, a method for conditioning a polishing pad used in chemical mechanical planarization of a semiconductor wafer, the polishing pad having a polishing surface for polishing the semiconductor wafer, and a back surface opposed to the polishing surface, is provided. The method includes moving the polishing pad past a source of sonic energy, and applying sonic energy to the polishing pad in a direction through the back surface and to the polishing surface of the polishing belt.

According to another aspect of the present invention, a wafer polisher for chemical mechanical planarization of a semiconductor wafer is provided. The wafer polisher includes a polishing pad having a polishing surface for polishing a semiconductor wafer, and a back surface opposed to the polishing surface, and a pad conditioner for conditioning the polishing pad, wherein the pad conditioner includes a sonic energy generator adjacent the back surface that transmits sonic energy in a direction through the back surface and to the polishing surface of the polishing belt.

According to another aspect of the present invention, a pad conditioner for conditioning a polishing pad having a polishing surface for polishing a semiconductor wafer, and a back surface opposed to the polishing surface, is provided.

The pad conditioner includes a sonic energy generator adapted to be positioned adjacent the back surface, the sonic energy generator including a transducer connected to a contact member, wherein the sonic energy generator is adapted to transmit sonic energy in a direction through the back surface and to the polishing surface of the polishing belt.

Figure 1:
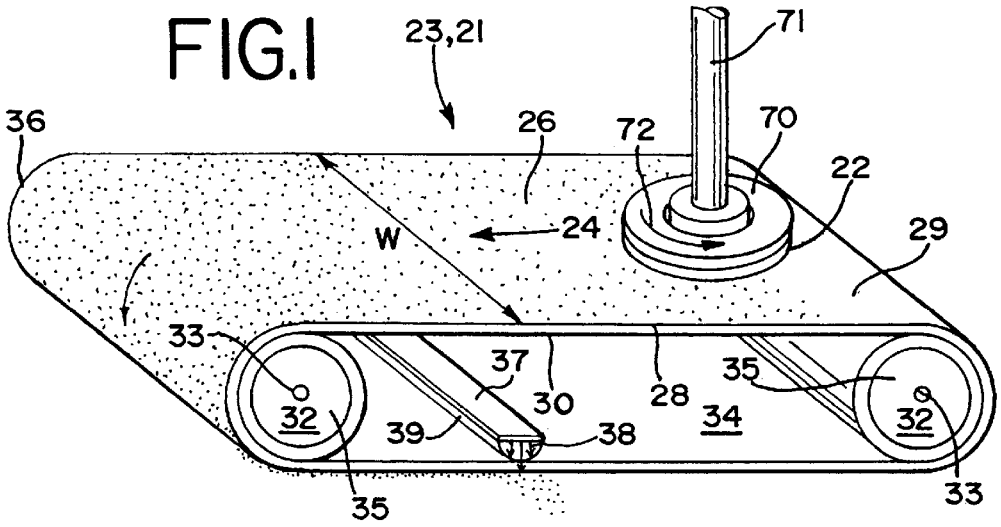
FIG. 1 is a perspective view of a pad conditioner, in accordance with one embodiment.

For simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DETAILED DESCRIPTION OF THE PRESENTLY PREFERRED EMBODIMENTS

Figure 2:
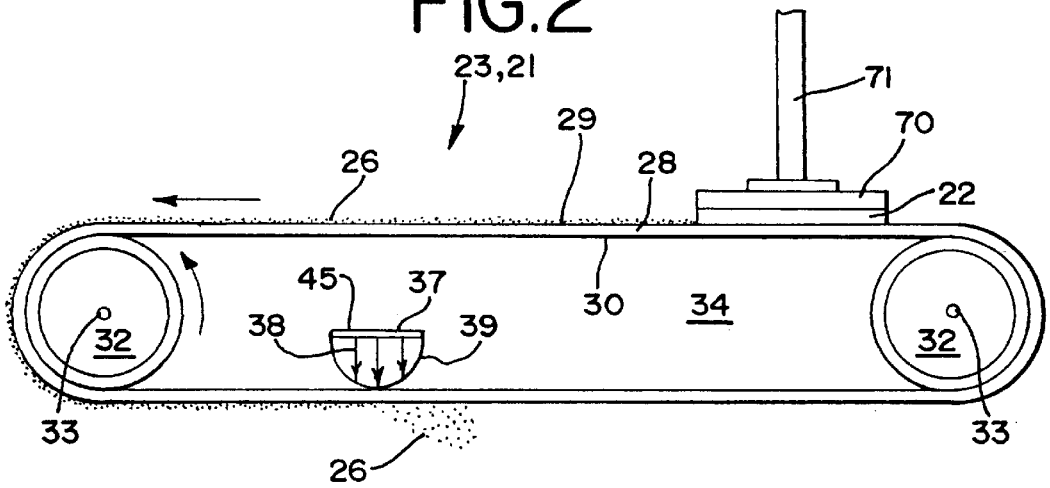
FIG. 2 is a side view of the pad conditioner of FIG. 1.

FIGS. 1 and 2 illustrate one embodiment of a wafer polisher 23, or CMP system, for chemical mechanical planarization of a semiconductor wafer 22. Wafer polisher 23 is any device that provides planarization to a substrate surface, and therefore can be used for chemical mechanical planarization of a semiconductor wafer 22, such as a linear polisher, a radial polisher, and an orbital polisher. In one embodiment, wafer polisher 23 includes a polishing pad 28 and a rotating wafer holder 70 attached to a shaft 71 that brings the semiconductor wafer 22 into contact with the polishing pad 28 moving in a forward direction 24 in the plane of the wafer surface to be planarized. The wafer holder 70 then presses the semiconductor wafer 22 against a polishing surface 29 of the rotating polishing pad 28 and the semiconductor wafer 22 is rotated to polish and planarize the semiconductor wafer 22.

During the polishing process, the properties of the polishing pad 28 can change. Particles 26, such as slurry particles and polishing byproducts, accumulate on the polishing surface 29 of the polishing pad 28. Removing these particles 26 using conventional pad conditioners tends to erode and reduce the life of the polishing pad 28, because conventional pad conditioners use abrasives to wear down and resurface the polishing surface 29 of the polishing pad 28. In accordance with one embodiment of this invention, a sonic energy generator 37 is positioned adjacent to or below a back surface 30 of the polishing pad 28 and sonic energy 38 is applied to the polishing pad 28 to remove or dislodge the particles 26 from the polishing surface 29 without abrading the polishing surface 29. Because no physical contact is made with the polishing surface and the sonic energy 38 applied to polishing pad 28 does not abrade the polishing surface 29, the life of the polishing pad 28 can be increased. Sonic energy generator 37 may be used either while wafer polisher 23 is in operation or while wafer polisher 23 is not in operation.

Figure 3:
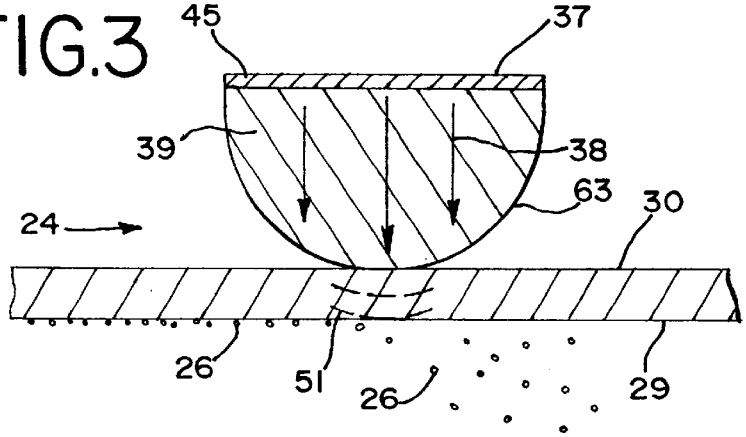
FIG. 3 is an enlarged cross-sectional side view of the pad conditioner of FIG. 2.

In one embodiment, the wafer polisher 23 includes a polishing pad 28 and a pad conditioner 20, as illustrated in FIGS. 1–3. Polishing pad 28 has a polishing surface 29 for polishing a semiconductor wafer 22 and a back surface 30 opposed to the polishing surface 29. Polishing surface 29 comes into direct contact with semiconductor wafer 22 when polishing semiconductor wafer 22, as illustrated in FIGS. 1–2. Polishing pad 28 may include a fixed abrasive pad or a non-abrasive pad configured to transport chemical slurry. In one embodiment, polishing pad 28 includes a fixed abrasive pad having abrasive particles embedded within a polymer matrix. Suitable abrasive particles include any particles which can be used to wear down or reduce a surface known by those skilled in the art, such as particles of sand, silica, alumina ($Al_2O_3$), zirconia, ceria and diamond. The polymer matrix is used to hold abrasive particles, and may include different kinds of polymers known to those skilled in the art that can be used to suspend or hold abrasive particles. In one embodiment, polishing pad 28 includes a non-abrasive pad. The non-abrasive pad can include any one of a hard polishing pad, an intermediate polishing pad, or a soft polishing pad manufactured from materials such as, but not limited to synthetic polymers such as polyurethane, extended fibers, and felt impregnated with polymer. An example of a suitable polyurethane pad is the IC1000 pad manufactured by Rodel Corporation of Delaware, USA. In one embodiment, a polishing fluid 27, such as a chemical polishing agent or a slurry containing microabrasives, is applied to a polishing surface 29 of the non-abrasive pad to polish the semiconductor wafer 22.

Figure 5:
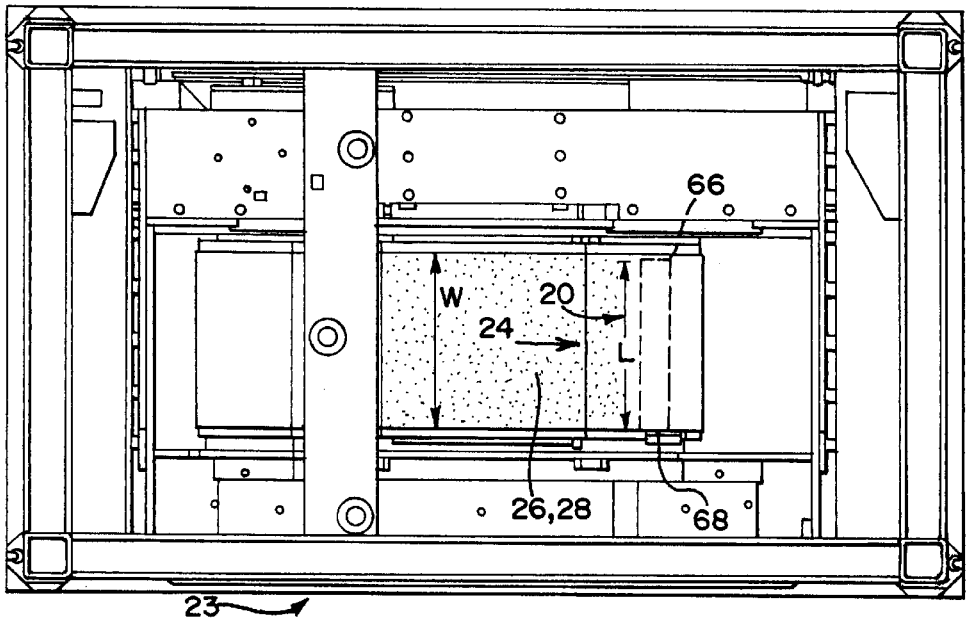
FIG. 5 is a top view of the pad conditioner and linear polisher of FIG. 4.
Figure 6:
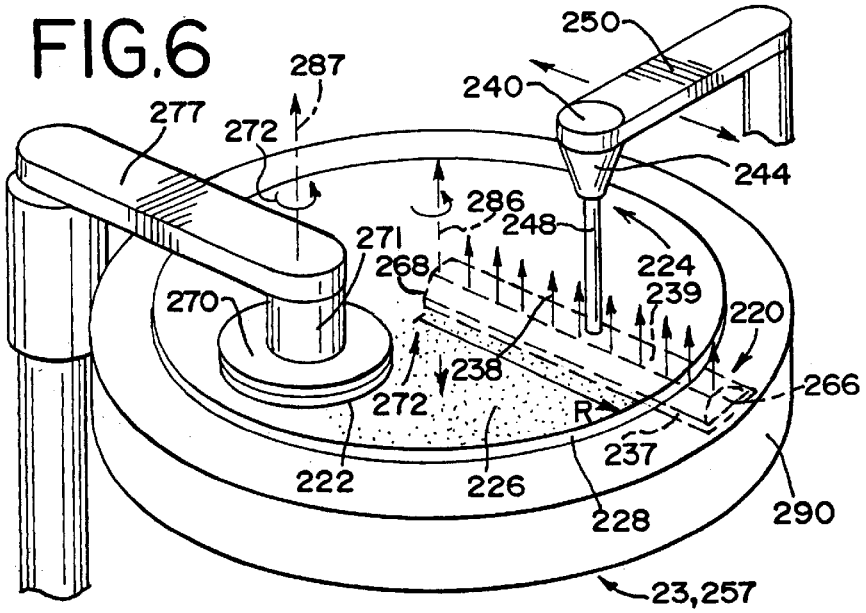
FIG. 6 is a perspective view of a pad conditioner used with a radial polisher, in accordance with one embodiment.

Pad conditioner 20 is used to condition the polishing pad 28, preferably for use in chemical mechanical planarization of semiconductor wafers 22. More specifically, pad conditioner 20 is used to condition the polishing surface 29 of polishing pad 28. As used herein, conditioning of the polishing pad 28 refers to the removal of particles 26 from polishing pad 28 generated during the CMP process. Pad conditioner 20 includes a sonic energy generator 37 for generating sonic energy 38. Preferably, sonic energy generator 37 is disposed along the width W or radius R of polishing pad 28, as illustrated in FIGS. 1 and 6. Sonic energy generator 37 has a length L defined as the distance between a first end 66, 266 and a second end 68, 268, as illustrated in FIGS. 5 and 6. Preferably, sonic energy generator 37 has a length L that is equal to a substantial amount of, or greater than, the width W or radius R of polishing pad 28 to allow pad conditioner 20 to condition all or a substantial amount of the surface of polishing pad 28. By positioning sonic energy generator 37 along the width W or radius R of polishing pad 28, and by giving sonic energy generator 37 a length L, sonic energy generator 37 is able to uniformly transmit sonic energy 38 across the width W or radius R of polishing pad 28 since sonic energy generator 37 conditions a substantial portion of the width W or radius R of polishing pad 28 at any given time. In one embodiment, sonic energy generator 37 has a length L that is less than the width W of polishing pad 28. In one embodiment, sonic energy generator 37 includes a longitudinal axis 55 that extends from first end 66 to second end 68, as illustrated in FIG. 5. Preferably, the longitudinal axis 55 is aligned in a direction generally perpendicular with forward direction 24 of polishing pad 28, as illustrated in FIGS. 1 and 6. While sonic energy generator 37 forms a generally rectangular or linear footprint over polishing pad 28, as illustrated in FIGS. 1 and 5, sonic energy generator 37 can form a footprint having any one of a variety of shapes, such as, a v-shape, a w-shape, a u-shape, and any other irregularly shaped footprint over polishing pad 28. In one embodiment, sonic energy generator 37 is mounted onto a mechanical arm (not shown) and is swept across the back surface 30 of polishing pad 28.

In one embodiment, sonic energy generator 37 includes a transducer 45, as illustrated in FIG. 3. Transducer 45 is any device known to those skilled in the art which can generate sonic energy 38. As used herein, sonic energy 38 is defined as any energy that is produced by, relating to, or utilizing, sound waves and/or vibrations. Transducer 45 may include, but is not limited to, a megasonic transducer and an ultrasonic transducer. Transducer 45 generates sonic energy 38 that forms acoustic waves 51 which are transmitted through polishing pad 28. Preferably, transducer 45 is in direct contact with the back surface 30 of polishing pad 28. However, transducer 45 may be positioned within 5 millimeters of the back surface 30 of polishing pad 28 and coupled acoustically to the back surface 30 with fluid such as water. Acoustic waves 51 are transmitted through polishing pad 28 in a direction from the back surface 30 to the polishing surface 29 of polishing pad 28. As the acoustic waves 51 pass through polishing pad 28 and polishing surface 29, the acoustic waves 51 cause particles 26 to be removed or dislodged from the polishing surface 29 of the polishing pad 28, as illustrated in FIGS. 1–3 and 9.

Figure 9:
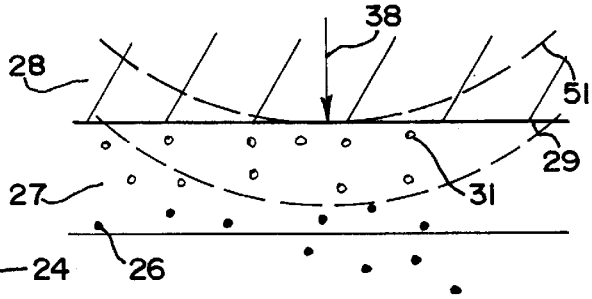
FIG. 9 is an enlarged cross-sectional side view of the polishing pad, in accordance with one embodiment.

In one embodiment, transducer 45 includes a megasonic transducer which generates sonic energy 38 at a frequency of between about 500 and about 1200 kHz. The megasonic transducer uses the piezoelectric effect to create sonic energy 38, as illustrated in FIGS. 1–3. A ceramic piezoelectric crystal (not shown) is excited by high-frequency AC voltage, causing the crystal to vibrate. In one embodiment, the megasonic transducer generates controlled acoustic cavitation in polishing fluid 27 of polishing pad 28, as illustrated in FIG. 9. Acoustic cavitation is produced by the pressure variations in sound waves, such as acoustic waves 51, moving through a liquid, such as polishing fluid 27. Acoustic cavitation forms cavitation bubbles 31 that remove or help dislodge particles 26, as illustrated in FIG. 9. The megasonic transducer produces controlled acoustic cavitation which pushes the particles 26 away from the polishing surface 29 of polishing pad 28 so that the particles 26 do not reattach to the polishing pad 28.

The amount of particles 26 that may be removed or dislodged from polishing pad 28 depends on a number of variables, such as the distance between the sonic energy generator 37 and the polishing pad 28, the power input to the sonic energy generator 37, the frequency at which the power input to sonic energy generator 37 is pulsating at, the frequency of the sonic energy 38 generated by the sonic energy generator 37, and dissolved gas content in the polishing fluid 27. In one embodiment, the amount of particles 26 that can be removed or dislodged from polishing surface 29 of polishing pad 28 by using sonic energy generator 37 is controlled by varying the power input to sonic energy generator 37. Preferably, between about 300 and about 1000 watts of power are input to sonic energy generator 37, and more preferably between about 500 and about 700 watts are input to transducer 45. In one embodiment, the power input to sonic energy generator 37 is pulsed at a frequency of between about 70 Hz and about 130 Hz of continuous power to provide better control over acoustic cavitation than applying continuous input power. In one embodiment, the frequency of the sonic energy 38 generated by the sonic energy generator 37 is between about 500 and about 1200 Hz. In one embodiment, the power output by the sonic energy generator 37 is between about 300 watts/cm$^2$ and about 1000 watts/cm$^2$.

As defined herein, ultrasonic transducers generate sonic energy 38 having a frequency of between about 20 and 500 kHz and produce random acoustic cavitation, while megasonic transducers generate sonic energy 38 having a frequency of between about 500 and 1200 kHz and produce controlled acoustic cavitation. An important distinction between the two methods is that the higher megasonic frequencies do not cause the violent cavitation effects found with ultrasonic frequencies. This significantly reduces or eliminates cavitation erosion and the likelihood of surface damage to the polishing pad 28.

Figure 7:
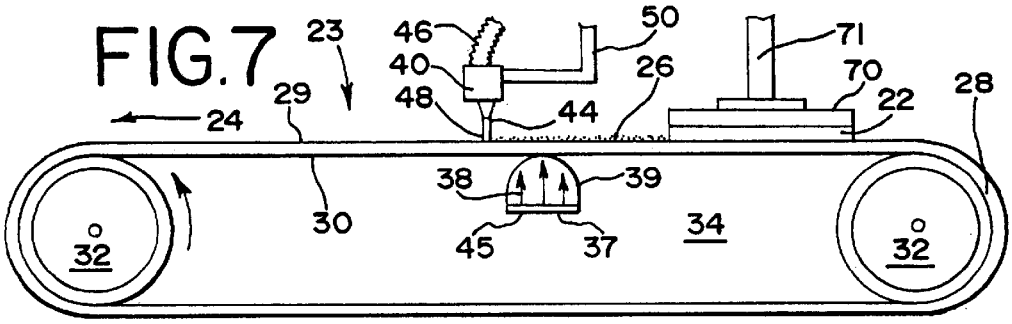
FIG. 7 is a side view of a pad conditioner, in accordance with one embodiment.
Figure 8:
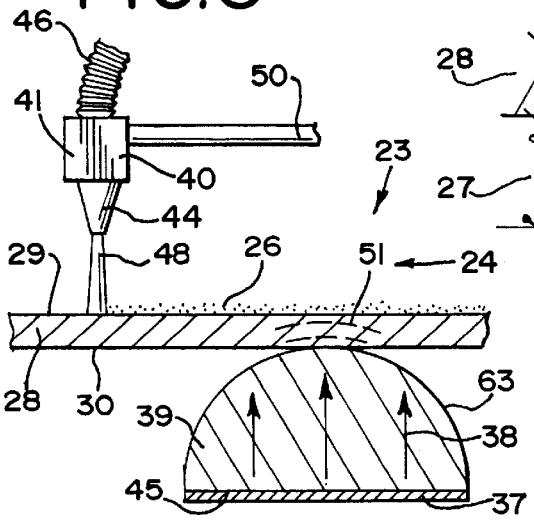
FIG. 8 is an enlarged cross-sectional side view of the pad conditioner of FIG. 7.

In one embodiment, pad conditioner 20 includes a liquid distribution unit 40, as illustrated in FIGS. 7–8. Liquid distribution unit 40 may be positioned upstream or downstream from sonic energy generator 37 and applies a high pressure stream 48 of liquid 43 on polishing surface 29 of polishing pad 28, as illustrated in FIGS. 7–8. Preferably, the high pressure stream 48 of liquid 43 extends across a substantial amount of the width W or radius R of polishing pad 28, in order to clean all or a substantial amount of particles 26 from polishing pad 28. Liquid distribution unit 40 includes liquid container 41 and forms at least one opening or nozzle 44 upon which liquid 43 is forced through at a relatively high pressure of about 100 kPa ("Kilo Pascals") to about 300 kPa. The nozzle 44 can be positioned very close to the polishing surface 29 of polishing pad 28 to minimize the length of the high pressure stream 48 of liquid 43. In one embodiment, nozzle 44 is positioned between about 5 and about 25 mm from polishing surface 29. Liquid container 41 stores an amount of liquid 43 before the liquid 43 is actually forced out of nozzle 44. Preferably, liquid container 41 is maintained at a pressure of about 100 kPa ("Kilo Pascals") to about 300 kPa. Nozzle 44 is positioned such that the liquid 43 which is forced out of nozzle 44 comes into contact with polishing pad 28. By forcing liquid 43 through nozzle 44 at high pressure and into contact with polishing pad 28, liquid distribution unit 40 is able to loosen and remove particles 26 from polishing pad 28. High pressure stream 48 helps in removing particles 26 from polishing pad 28. In one embodiment, liquid container 41 is in connection with a liquid hose 46. Liquid hose 46 supplies liquid 43 to liquid container 41, preferably at high pressure. Liquid hose 46 may be comprised of any suitable material such as PTE or rubber. Liquid 43 includes any liquid that can be applied to a surface. In one embodiment, liquid 43 includes a liquid selected from the group consisting of water, potassium hydroxide, ammonium hydroxide, combinations of the above with hydrogen peroxide, combinations of the above with chelating agents such as EDTA and citric acid, dilute water, dilute ammonia, and a combination of ammonia, water, and hydrogen peroxide. Preferably, liquid 43 is kept at a uniform temperature which would be specific to a given CMP process. The temperature would be controlled to better than ±5° C.

In one embodiment, liquid distribution unit 40 forms a series of nozzles 44 upon which liquid 43 is forced through at a relatively high pressure of between about 100 kPa ("Kilo Pascals") to about 300 kPa. Liquid 43 is forced through the nozzles 44 to form a high pressure stream 48 of liquid 43 having a fan-like shape. Preferably, nozzles 44 span at least 50% of the width of polishing pad 28. In one embodiment, small nozzles 44 span substantially all the width of polishing pad 28. In one embodiment, liquid distribution unit 40 forms a series of small slits in which liquid 43 is forced through at relatively high pressure. In one embodiment, liquid distribution unit 40 forms at least one long slit, spanning substantially all the width W or radius R of polishing pad 28, in which liquid 43 is forced through at relatively high pressure. Further, it will be recognized by those skilled in the art that liquid distribution unit 40 may form a variety of openings or nozzles 44 that can accomplish the task of spraying liquid 43 at high pressure against the surface of polishing pad 28, such as a water jet array or a water knife. In one embodiment, liquid distribution unit 40 is mounted onto a first arm 50, as illustrated in FIG. 8. First arm 50 moves the high pressure stream 48 of liquid 43 across the polishing surface 29 of polishing pad 28 to remove particles 26.

In one embodiment, sonic energy generator 37 includes a contact member 39. Contact member 39 is connected with transducer 45 and is used to transmit sonic energy 38 across to polishing pad 28. Preferably, contact member 39 is located between transducer 45 and the back surface 30 of polishing pad 28, as illustrated in FIGS. 1–3. In one embodiment, contact member 39 is located within 5 millimeters of the back surface 30 of polishing pad 28, as illustrated in FIGS. 1–3, in order to increase the amount of acoustic waves 51 transmitted through polishing pad 28. Preferably, contact member 39 comes into direct contact with the back surface 30 of polishing pad 28. Contact member 39 may be manufactured from any suitable material, such as stainless steel, brass, aluminum, titanium, any metal, or a metal with a polymer coating such as PTE. Preferably, contact member 39 includes a curved portion 63 that comes into contact with a portion of back surface 30, as illustrated in FIGS. 3 and 8. Curved portion 63 reduced the amount of wear and tear on back surface 30 from contact member 39.

In one embodiment, wafer polisher 23 is a linear polisher 21 wherein the polishing pad 28 is a linear belt that travels in one direction, as illustrated in FIGS. 1–5. In this embodiment, the polishing pad 28 is mounted on a series of rollers 32, as illustrated in FIGS. 1–2. The polishing pad 28 forms a cavity 34 between the two rollers 32, as illustrated in FIGS. 1–2. In one embodiment, at least a portion of pad conditioner 20 is positioned in the cavity 34. In one embodiment, sonic energy generator 37 is positioned in the cavity 34.

Figure 4:
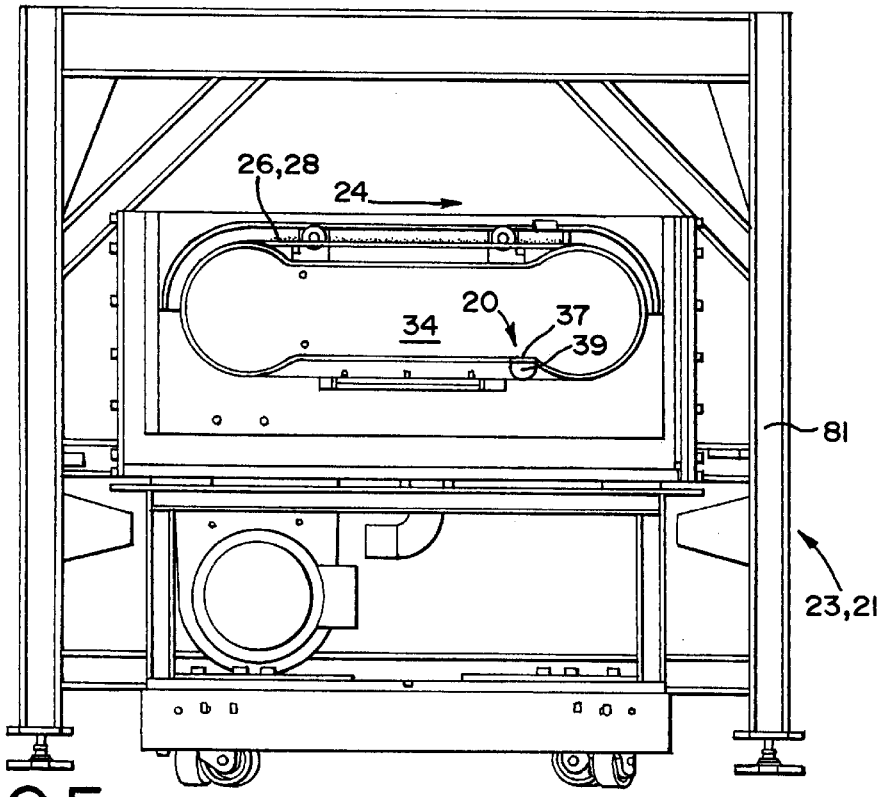
FIG. 4 is a side view of the pad conditioner of FIG. 1 used with a linear polisher, in accordance with one embodiment.

Rollers 32 preferably include coaxially disposed shafts 33 extending through the length of rollers 32. Alternatively, each shaft 33 may be two separate coaxial segments extending partway in from each of the ends 35, 36 of rollers 32. In yet another embodiment, each shaft 33 may extend only partly into one of the ends 35, 36 of rollers 32. Connectors (not shown) on either end 35, 36 of rollers 32 hold each shaft 33. A motor (not shown) connects with at least one shaft 33 and causes rollers 32 to rotate, thus moving polishing pad 28. Preferably, polishing pad 28 is stretched and tensed when mounted on rollers 32, thus causing pores of on the surface of polishing pad 28 to open in order more easily loosen and remove particles 26 from polishing pad 28. In one embodiment, polishing pad 28 is stretched and tensed to a tension of approximately 7500 kPa. FIG. 4 illustrates one environment in which one embodiment of pad conditioner 20 may operate. In FIG. 4, pad conditioner 20 is positioned in cavity 34 of polishing pad 28 which is attached to a frame 81 of wafer polisher 23. The wafer polisher 23 may be a linear polisher such as the TERES™ polisher available from Lam Research Corporation of Fremont, Calif. The alignment of the pad conditioner 20 with respect to the polishing pad 28 is best shown in FIGS. 1, 4, and 5.

In one embodiment, wafer polisher 23 is a radial polisher 257 having polishing pad 228 mounted on circular disc 290 that rotates in a forward direction 224, as illustrated in FIG. 6. Preferably, polishing pad 228 is a radial disc. Wafer polisher 23 includes a rotating wafer holder 270 attached to a shaft 271 that brings the semiconductor wafer 222 into contact with polishing pad 228 moving in forward direction 224 in the plane of the wafer surface to be planarized, as illustrated in FIG. 6. Preferably, shaft 271 is mounted onto a mechanical arm 277. Mechanical arm 277 allows semiconductor wafer 222 to move across the polishing surface 229 of polishing pad 228. Circular disc 290 rotates about a first axis 286 while semiconductor wafer 222 and wafer holder 270 rotate about a second axis 287 located a distance away from first axis 286. Preferably, first axis 286 is positioned coaxially with second axis 287. Pad conditioner 220 is mounted radially about polishing pad 228 by using a mount (not shown) or a mechanical arm (not shown). By positioning pad conditioner 220 radially about polishing pad 228, pad conditioner 220 is able to condition a substantial amount, if not all, of polishing pad 228, as illustrated in FIG. 6. Radial polisher 257 may be any radial polisher, such as, the MIRRA™ polisher available from Applied Materials of Santa Clara, Calif. The alignment of the pad conditioner 220 with respect to the polishing pad 228 is best shown in FIG. 6.

In one embodiment, pad conditioner 220 includes a liquid distribution unit 240, as illustrated in FIG. 6. Liquid distribution unit 240 may be positioned upstream or downstream from sonic energy generator 237 and applies a high pressure stream 248 of liquid 243 on polishing surface 229 of polishing pad 228, as illustrated in FIG. 6. Preferably, the high pressure stream 248 of liquid 243 extends across a substantial amount of the radius R of polishing pad 228, in order to clean all or a substantial amount of particles 226 from polishing pad 228. Liquid distribution unit 240 forms at least one opening or nozzle 244 upon which liquid 243 is forced through at a relatively high pressure of about 100 kPa ("Kilo Pascals") to about 300 kPa. The nozzle 244 can be positioned very close to the polishing surface 229 of polishing pad 28 to minimize the length of the high pressure stream 248. In one embodiment, nozzle 244 is positioned between about 5 mm and about 25 mm from polishing surface 229. Nozzle 244 is positioned such that the liquid 243 comes into contact with polishing pad 228. By forcing liquid 243 through nozzle 244 at high pressure and into contact with polishing pad 228, liquid distribution unit 240 is able to loosen and remove particles 226 from polishing pad 228. High pressure stream 248 of liquid 243 helps in removing particles 226 from polishing pad 228. In one embodiment, liquid distribution unit 240 is mounted onto a first arm 250, as illustrated in FIG. 6. First arm 250 moves high pressure stream 248 of liquid 243 across the polishing surface 229 of polishing pad 228 to remove particles 226.

During operation, wafer polisher 23 is activated and polishing pad 28 begins to move in a forward direction 24, as illustrated in FIGS. 1 and 6. As polishing pad 28 moves, polishing fluid 27 is applied to polishing pad 28. Polishing pad 28 then moves across the surface of and polishes semiconductor wafer 22. Upon moving across the surface of semiconductor wafer 22, polishing pad 28 becomes contaminated with particles 26 from the surface of semiconductor wafer 22. Polishing pad 28, contaminated with particles 26, then approaches pad conditioner 20. Pad conditioner 20 includes a sonic energy generator 37 positioned adjacent the back surface 30 of the polishing pad 28. Sonic energy generator 37 applies sonic energy 38 to the back surface 30 of the polishing pad 28. The sonic energy 38 is transmitted through the polishing pad 28 and to the polishing surface 29 of the polishing pad 28, whereupon particles 26 are removed or dislodged from the polishing surface 29 of the polishing pad 28, as illustrated in FIGS. 1–3 and 9. In one embodiment, a liquid distribution unit 40 is positioned downstream from sonic energy generator 37 and applies a high pressure stream 48 of liquid 43 onto polishing pad 28 in order to further loosen and remove the particles 26 from polishing pad 28.

An advantage of the presently preferred pad conditioner 20 is that a substantial amount of particles 26 can be removed from polishing pad 28 without using harsh abrasives that can either damage polishing pad 28 or cause excessive wear onto the polishing surface 29 of polishing pad 28. Thus, the polishing pad 28 can retain an active polishing surface 29 with reduced wear and reduced particles 26.

Thus, there has been disclosed in accordance with the invention, a method and apparatus for conditioning a polishing pad used in the chemical mechanical planarization of semiconductor wafers that fully provides the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications that fall within the scope of the appended claims and equivalents thereof.

What is claimed is:

1. A method for conditioning a polishing pad used in chemical mechanical planarization of a semiconductor wafer, the polishing pad having a polishing surface for polishing the semiconductor wafer, and a back surface opposed to the polishing surface, the method comprising:

positioning a sonic energy generator adjacent to the back surface of the polishing pad;

generating sonic energy through the back surface of the polishing pad; and moving said polishing pad past the sonic energy generator while sonic energy is generated through the back surface of the polishing pad.

2. The method of claim 1, wherein the sonic energy is between 100 and 1000 watts of power.

3. The method of claim 1, wherein the sonic energy is at a frequency of between about 500 and about 1200 kHz.

4. The method of claim 1, wherein the polishing pad is a linear belt.

5. The method of claim 4, wherein the linear belt forms a cavity, and the sonic energy generator is positioned within the cavity facing the back surface of the linear belt.

6. The method of claim 1, wherein the polishing pad is a radial disc.

7. The method of claim 1, wherein the sonic energy comprises one of ultrasonic energy and megasonic energy.

8. The method of claim 1, wherein the sonic energy generator is positioned within 5 millimeters of the back surface.

9. A method for conditioning a polishing pad used in chemical mechanical planarization of a semiconductor wafer, the polishing pad having a polishing surface for polishing the semiconductor wafer, and a back surface opposed to the polishing surface, the method comprising:

moving the polishing pad past a fixed source of sonic energy; and applying sonic energy to the polishing pad in a direction through the back surface and to the polishing surface of the polishing pad.

10. The method of claim 9, wherein the sonic energy is between 300 and 1000 watts of power.

11. The method of claim 9, wherein the sonic energy is at a frequency of between about 500 and about 1200 kHz.

12. The method of claim 9, wherein the polishing pad is a linear belt.

13. The method of claim 9, wherein the polishing pad is a radial disc.

14. A wafer polisher for chemical mechanical planarization of a semiconductor wafer, the wafer polisher comprising:

a polishing pad having a polishing surface for polishing a semiconductor wafer, and a back surface opposed to the polishing surface; and a pad conditioner for conditioning the polishing pad, wherein the pad conditioner includes a sonic energy generator adjacent the back surface that transmits sonic energy in a direction through the back surface and to the polishing surface of the polishing pad while the polishing pad moves past the sonic energy generator.

15. The wafer polisher of claim 14, wherein the sonic energy generator comes into direct contact with the back surface of the polishing pad.

16. The wafer polisher of claim 14, wherein the polishing pad is a continuous, linear belt.

17. The wafer polisher of claim 14, wherein the polishing pad is a radial disc.

18. The wafer polisher of claim 14, wherein the pad conditioner includes a liquid distribution unit for applying a high pressure stream of liquid onto the polishing surface.

19. A wafer polisher for chemical mechanical planarization of a semiconductor wafer, the wafer polisher comprising:

a polishing pad having a polishing surface for polishing a semiconductor wafer, and a back surface opposed to the polishing surface, wherein the polishing pad comprises a linear belt wrapped around at least two rollers, and wherein the linear belt forms a cavity;

a pad conditioner for conditioning the polishing pad, wherein the pad conditioner transmits sonic energy in a direction through the back surface and to the polishing surface of the polishing pad while the polishing pad moves past sonic energy being transmitted in a direction through the back surface and to the polishing surface of the polishing pad.

20. The wafer polisher of claim 19, wherein the sonic energy is between 300 and 1000 watts of power.

21. The wafer polisher of claim 19, wherein the sonic energy is at a frequency of between about 500 and about 1200 kHz.

22. The wafer polisher of claim 19, wherein at least a portion of the pad conditioner is positioned within 5 millimeters of the back surface.

23. A pad conditioner for conditioning a polishing pad having a polishing surface for polishing a semiconductor wafer, and a back surface opposed to the polishing surface, the pad conditioner comprising:

a sonic energy generator positioned adjacent the back surface, the sonic energy generator including a transducer connected to a contact member, wherein the sonic energy generator transmits sonic energy in a direction through the back surface and to the polishing surface of the polishing pad while the polishing pad is moved past the contact member.

24. The pad conditioner of claim 23, further comprising a liquid distribution unit for generating a high pressure stream of liquid.

* * * * *